US005925152A

United States Patent [19]

Barratt et al.

[11] Patent Number: 5,925,152

[45] **Date of Patent: *Jul. 20, 1999**

[54] GASOLINE COMPOSITION

[75] Inventors: David John Barratt; Jian Lin, both of Chester, United Kingdom

[73] Assignee: Shell Oil Company, Houston, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/746,823

[22] Filed: Nov. 18, 1996

[30] Foreign Application Priority Data

Mar. 15, 1996 [EP] European Pat. Off. ..... 96301781

[51] Int. Cl.[6] ..... C10L 1/18

[52] U.S. Cl. ..... 44/350; 44/340; 44/352

[58] Field of Search ..... 44/350, 352

[56] References Cited

U.S. PATENT DOCUMENTS

| | | | |
|---|---|---|---|
| 2,201,553 | 5/1940 | Bean | 44/350 |
| 2,262,466 | 11/1941 | Orelup | 44/352 |
| 2,283,388 | 5/1942 | Paul et al. | 44/350 |
| 2,321,311 | 6/1943 | Mottlau et al. | 44/350 |
| 2,599,338 | 6/1952 | Lifson et al. | 44/350 |
| 2,682,473 | 6/1954 | Thompson et al. | 44/350 |
| 2,687,419 | 8/1954 | Hillyer | 44/350 |
| 2,959,589 | 11/1960 | Ramsden | 44/350 |
| 3,184,457 | 5/1965 | Brannock et al. | 44/350 |
| 3,892,783 | 7/1975 | Duke | 549/506 |
| 3,909,216 | 9/1975 | Stearns et al. | 44/352 |
| 4,191,536 | 3/1980 | Niebylski | 44/352 |
| 4,339,245 | 7/1982 | Burns | 44/350 |
| 4,810,262 | 3/1989 | Lewtas et al. | 44/352 |
| 5,196,035 | 3/1993 | Johnson | 44/350 |
| 5,354,344 | 10/1994 | Takizawa et al. | 44/439 |

*Primary Examiner*—Ellen M. McAvoy

[57] ABSTRACT

The invention provides a gasoline composition which comprises a mixture of hydrocarbons of the gasoline boiling range containing an octane requirement reducing amount of an additive comprising a furan derivative containing a furyl group bearing one or more substituents comprising one or more heterocyclic and/or one or more aryl groups; a concentrate for the preparation of such gasoline composition and a method of operating a spark-ignition engine using such gasoline composition.

9 Claims, No Drawings

GASOLINE COMPOSITION

FIELD OF THE INVENTION

The present invention relates to a gasoline composition comprising a mixture of hydrocarbons of the gasoline boiling range containing an octane requirement reducing amount of an additive which comprises a particular furan derivative.

BACKGROUND OF THE INVENTION

The octane requirement increase (ORI) effect exhibited by internal combustion engines, e.g. spark ignition engines, is well known in the art. This effect may be described as the tendency for an initially new or clean engine to require higher octane quality fuel as operating time accumulates, and is coincidental with the formation of deposits in the region of the combustion chamber of the engine. Thus, during the initial operation of a new or clean engine, a gradual increase in octane requirement (OR), i.e. fuel octane number required for knock-free operation, is observed with an increasing build-up of combustion chamber deposits until a rather stable OR level is reached. This, in turn, seems to correspond to a point in time where the quantity of deposit accumulation on the combustion chamber and valve surfaces no longer increase but remains relatively constant (i.e., equilibrium value). This so-called "equilibrium value" is usually reached between about 4,800 and 32,000 km. or corresponding hours of operation. The actual equilibrium value of this increase can vary with engine design and even with individual engines of the same design. However, in almost all cases the increase appears to be significant, with ORI values ranging from about 2 to 14 Research Octane Numbers (RON) being commonly observed in modern engines.

Various types of additives are known which may prevent or reduce deposit formation, or remove or modify deposits, in the combustion chamber and adjacent surfaces and hence decrease OR. These additives are generally known as octane requirement reduction (ORR) agents.

Object of the present invention is to provide a gasoline composition containing an additive selected from a particular class of furan derivatives which exhibit a surprisingly high octane requirement reduction activity.

SUMMARY OF THE INVENTION

The present invention provides a gasoline composition which comprises a mixture of hydrocarbons of the gasoline boiling range containing an octane requirement reducing amount of an additive, said additive comprising a furan derivative containing a furyl group bearing one or more substituents comprising one or more heterocyclic and/or aryl groups.

DETAILED DESCRIPTION OF THE INVENTION

According to an embodiment of the present invention, the heterocyclic group(s) of the furyl group may be any optionally substituted saturated or unsaturated ring system, (e.g. a 5–7 membered ring system), containing at least one heteroatom selected from oxygen, nitrogen and sulphur, 5- and 6-membered rings being preferred, (e.g. a furyl, piperidinyl, pyridinyl, pyrrolyl, triazinyl, imidazolinyl or thiophenyl (thienyl) groups). More preferred are 5-membered ring systems comprising oxygen and/or nitrogen.

The aryl group(s) of the furyl group may be any optionally substituted benzyl or phenyl groups. The phenyl or benzyl groups may be unsubstituted or substituted by an alkyl group.

Without limitation, examples of substituent groups for both the heterocyclic and aryl groups include halogen atoms (e.g. chlorine atoms), nitro, hydroxyl, carboxyl, amino, cyano, formyl, alkoxycarbonyl, alkanoyl, alkylthio, alkylsulphinyl, alkylsulphonyl, carbamoyl and alkylamido groups. When one of the foregoing substituents groups contain an alkyl or alkylene moiety, the moiety may be linear or branched and may contain up to 12, preferably up to 6, especially up to 4, carbon atoms.

The heterocyclic group(s) and/or aryl group(s) are connected to the furyl group directly or by means of an optionally substituted hydrocarbyl, carbonyl, dicarbonyl or alkoxycarbonyl group. Additional heterocyclic and aryl groups may also be connected to a heterocyclic or aryl group which is connected to the furyl group as described hereinbefore.

Suitably, the furyl groups bears a single substituent comprising one or more heterocyclic and/or on or more aryl groups.

In another embodiment of the present invention, the number of heterocyclic and/or aryl groups present in addition to the furyl group ranges from 1 to 5, preferably from 1 to 4.

Suitably, the furan derivatives has a molecular weight in the range from 100 to 5000, preferably in the range from 100 to 500 .

Suitable furan derivatives to be used in accordance with the present invention include those having a following general formula:

(I)

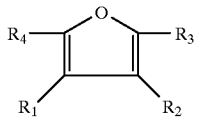

wherein R1, R2, R3 and R4 are hydrogen, a heterocyclic group or an aryl group as defined hereinbefore. Preferably, R3 and R4 represent any optionally substituted saturated or unsaturated ring system containing at least one heteroatom selected from the group consisting of oxygen, nitrogen and sulphur.

Gasoline composition according to the present invention may also contain other additives. For instance, the gasoline composition may contain a lead compound as anti-knock additive. The gasoline composition according to the present invention includes therefore both leaded and unleaded gasoline. Preferably, the gasoline composition according to the present invention is an unleaded (ashless) gasoline.

The gasoline composition may also contain any of the antioxidants known in the art. The gasoline composition may further suitably contain a non-ionic surfactant, such as an alkylphenol or an alkyl alkoxylate. Suitable examples of such surfactants include $C_{4-C18}$-alkylphenol and $C_2$–$C_6$-alkylethoxylate or $C_2$–$C_6$-alkylpropoxylate or mixtures thereof. The amount of the surfactant is advantageously from 10 to 1000 ppmw. The gasoline composition may still further contain a detergent such as a polyolefin-substituted succinimide. Suitable examples of such detergents include ether polyolefin-substituted succinimides as described in EP-A-271937, which is hereby incorporated by reference. The amount of detergent is advantageously from 10 to 1000 ppmw.

The gasoline composition according to the invention usually comprises a major amount (more than 50% w) of a base fuel, suitable for use in spark-ignition engines, and a minor amount of the additive described above, suitably from 0.005 to 10% wt being useful, with from 0.01 to 5% wt being preferred, and from 0.02 to 1% wt of the additive being more preferred, based on total gasoline composition.

The gasoline composition may also, include mixtures of hydrocarbons boiling essentially in the gasoline boiling range from 30 to 230° C. These mixtures may comprise saturated, olefinic and aromatic hydrocarbons. They can be derived from straight-run gasoline, synthetically produced aromatic hydrocarbon mixtures, thermally or catalytically cracked hydrocarbon feedstocks, hydrocracked petroleum fractions or catalytically reformed hydrocarbons. The octane number of the base fuel is not critical and generally be above 65. In the gasoline, hydrocarbons can be replaced by up to substantial amounts of alcohols, ethers, ketones (e.g. acetone) or esters. Naturally, the base fuels are substantially free of water since water may impede a smooth combustion.

In another embodiment of the invention, a concentrate suitable for addition to gasoline is provided. The concentrate comprises a gasoline-compatible diluent with from 5 to 75% w, calculated on the diluent, of an additive comprising any of the furan derivatives as described above.

The present invention further provides a method of operating a spark-ignition internal combustion engine which comprises introducing to said engine a gasoline composition in accordance with the present invention.

The present invention will be further illustrated by the following examples which are included for illustrative purposes only and are not to be construed as limiting the invention.

EXAMPLE 1

N-furfuryl-2-furamide was prepared by adding dropwise to a mixture of furfurylamine (7.44 g; 7 mmol; ex Aldrich) and triethylamine (35.6 g; 352 mmol) in dichloromethane 2-furoyl chloride (23 g; 176 mmol) at a temperature of 0 to 5° C. The product obtained was washed with water, dried with magnesium sulphate and evaporated. Subsequently, the product so obtained was purified by flash chromatography (silica, hexane/ethyl acetate as eluant) and 14 g (97% yield) of the product was recovered.

EXAMPLE 2

2-amino-1-(2-furanylmethyl)-4,5-difuryl-3-pyrrolecarbonitrile was prepared as follows: 300 g (1.56 mol) of Furoin (ex Aldrich) was reacted with 151.6 g (1.56 mol) of furfurylamine in the presence of 1.5 g of p-toluenesulphonic acid in toluene under stirring and reflux. The water produced was removed via a Dean Stark trap. When formation of water had ceased (31 ml removed), 103.1 g (1.56 mol) of malononitrile was added as a dispersion in 100 ml toluene, reflux was continued. When again formation of water had ceased (26 ml removed via the Dean Stark trap), the reaction mixture was cooled and the toluene was removed by evaporation. In this way 498 g of a black solid product was obtained. Subsequently, 100 g of this product was purified by flash chromatography (silica, hexane/ethyl acetate as eluant) and 24 g of the product was recovered.

EXAMPLE 3

N-phenyl furamide was prepared by adding to a mixture of aniline (23.3 g; 250 mmol) and triethylamine (25.3 g; 250 mmol) in dichloromethane slowly 32.6 g (250 mmol) of 2-furoyl chloride, while maintaining the temperature at −10° C. The product obtained was washed with diluted hydrochloric acid and water, dried with magnesium sulphate and evaporated. The product so obtained was than triturated with hexane and filtered. 39.3 g (84% yield of product was recovered.

EXAMPLE 4

This example illustrates the beneficial effect on octane requirement of gasoline additives comprising the furan derivative in accordance with the present invention.

Each of the products obtained in Examples 1 to 3 were tested in a single cylinder Hydra engine; experiments 1 to 3. In six further experiments (experiments 4–9) commercially available furan derivatives were tested in the same engine. In experiment 4 furfurylpyrrole (ex Aldrich) was tested. In experiment 5 Furil (ex Aldrich) was tested. In experiment 6 furfuryl benzoate (ex Aldrich) was tested. In experiment 7 2-furfuraldehyde diethylacetal was tested. In experiment 8 2-furaldehyde dimethylhydrazone (ex Aldrich) was tested. In experiment 9 furfuryl alcohol was tested.

Deposits were built up at 1000 rpm with wide open throttle (WOT) and high load during 200 hours with an unleaded gasoline containing 0.5 wt % fluoranthene. A method was developed to detect the high rate of change in cylinder pressure during autoignition and Knock Limited Spark Advance (KLSA) was determined under 1000 rpm and WOT conditions. Calibration tests with reference fuels showed that the engine responded to the Research Octane Number (RON) of the fuel and that the KLSA changed by approximately one crank angle degree (cad) per octane number. Starting from clean combustion chamber conditions, the KLSA of the Hydra engine was reduced by between 8 and 10 cad over the first 200 hours operation as combustion chamber deposits built up, after which it reached equilibrium. Each additive was tested over a period of continued running, after which the engine was reconditioned on base fuel.

The various properties of the additives, conditions applied and results of the experiments are shown in Table 1. It will be clear from these results that the use of the furan derivatives in accordance with the present invention (experiments 1–6) brings about a surprisingly high reduction in the octane requirement of the engine when compared with additives just falling outside the scope of the present invention (experiments 7–9).

TABLE 1

| Experiment | Mw | Dose g/l | DKLSA | Time hrs |
|---|---|---|---|---|
| 1 | 191.18 | 4 | 0.7 | 1 |
| 2 | 289.32 | 0.15 | 0.7 | 1 |
| 3 | 187.19 | 1 | 0.8 | 1 |
| 4 | 147.18 | 1 | 2.0 | 1 |
| 5 | 190.15 | 0.3 | 1.3 | 1 |
| 6 | 202.21 | 1 | 1 | 1 |
| 7 | 170.21 | 1 | 0 | 1 |
| 8 | 138.17 | 1 | −1 | 1 |
| 9 | 98.10 | 1 | 0.5 | 1 |

We claim:

1. A gasoline composition for reducing octane requirement which comprises a mixture of hydrocarbons of the gasoline boiling range and an additive comprising a furan derivative of the formula:

(I)

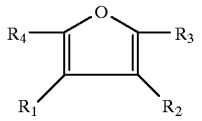

wherein $R_1$, $R_2$, $R_3$ and $R_4$ are each independently selected from hydrogen and one or more heterocyclic and/or aryl group(s) wherein the additive is present in an amount from 0.005 to 10% wt based on the total gasoline composition with the proviso that at least one of $R_1$, $R_2$, $R_3$ and $R_4$ is one or more heterocyclic and/or aryl group(s).

2. A gasoline composition according to claim 1, wherein the furan derivative bears a single substituent having one or more heterocyclic and/or aryl groups.

3. A gasoline composition according to claim 2, wherein the heterocyclic groups comprise unsaturated 5-membered ring systems containing an heteroatom selected from the group consisting of oxygen, nitrogen and sulfur.

4. A gasoline composition according to claim 3, wherein the aryl groups comprise benzyl or phenyl groups.

5. A gasoline composition according to claim 4, wherein the furan derivative has a molecular weight in the range from 100 to 5000 .

6. A gasoline composition according to claim 1, wherein R3 and R4 represent any optionally substituted saturated or unsaturated ring system containing at least one heteroatom.

7. A gasoline composition according to claim 1, further comprising antioxidants and detergents.

8. A gasoline composition comprising a major amount of a base fuel and from 0.005 to 10% wt based on the total gasoline composition of an additive comprising a furan derivative of the formula (I)

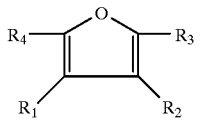

wherein $R_1$, $R_2$, $R_3$ and $R_4$ are each independently selected from hydrogen and one or more heterocyclic and/or aryl group(s) with the proviso that at least one of $R_1$, $R_2$, $R_3$ and $R_4$ is one or more heterocyclic and/or aryl group(s).

9. A concentrate for addition to gasoline comprising (a) a gasoline-compatible diluent and (b) from 5 to 75 % w, calculated on the diluent, of an additive comprising a furan derivative which contains a furyl group bearing one or more substituents having one or more heterocyclic and/or aryl groups, wherein the furyl group substituents are 5-membered ring systems comprising oxygen and/or nitrogen.

* * * * *